United States Patent [19]

Takiguchi

[11] 3,941,558

[45] Mar. 2, 1976

[54] CONTACT-HEATING FIXING DEVICE FOR ELECTROPHOTOGRAPHY

[75] Inventor: Koichi Takiguchi, Tokyo, Japan

[73] Assignee: Rank Xerox Ltd., London, England

[22] Filed: Nov. 11, 1974

[21] Appl. No.: 522,400

[30] Foreign Application Priority Data

Feb. 19, 1974 Japan ..... 49-19332

[52] U.S. Cl. ..... 432/60; 432/228; 432/75; 118/70; 15/256.52; 355/15

[51] Int. Cl.[2] ..... F27B 9/28

[58] Field of Search ..... 432/59, 60, 227, 228, 75; 219/469, 216, 388; 118/60, 70, 203, 637; 15/99, 102, 256.51, 256.52; 355/15

[56] References Cited

UNITED STATES PATENTS

| | | | |
|---|---|---|---|
| 2,056,273 | 10/1936 | Holdsworth | 118/206 |
| 3,175,923 | 3/1965 | Lerner | 118/70 |
| 3,510,903 | 5/1970 | Stoever et al. | 355/15 |
| 3,598,488 | 8/1971 | DiFrancesco | 355/15 |
| 3,617,123 | 11/1971 | Emerson | 355/15 |
| 3,637,976 | 1/1972 | Ohta et al. | 219/216 |
| 3,649,992 | 3/1972 | Thettu | 15/256.52 |
| 3,716,018 | 2/1973 | Ohta et al. | 118/60 |
| 3,796,183 | 3/1974 | Thettu | 118/70 |

*Primary Examiner*—John J. Camby
*Assistant Examiner*—Henry C. Yuen

[57] ABSTRACT

A contact-heat fixing device for electrophotography, characterized in that said fixing device comprises a cleaning member impregnated with an offset preventive liquid and a means for feeding said cleaning member in a state compressedly contacted with a heated body by means of a predetermined compressive force.

10 Claims, 3 Drawing Figures

FIG. 2
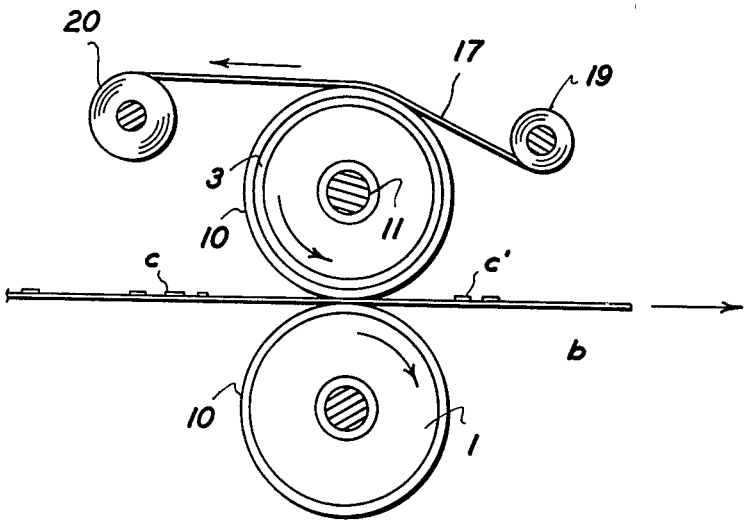
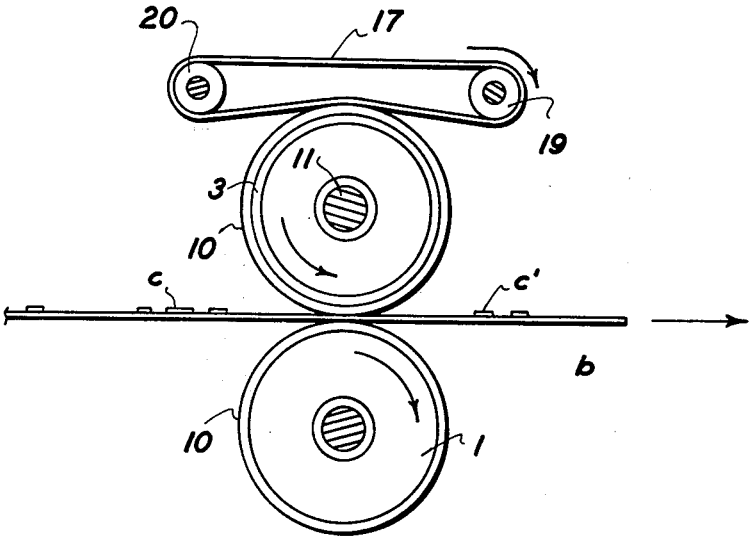
FIG. 3

CONTACT-HEATING FIXING DEVICE FOR ELECTROPHOTOGRAPHY

BACKGROUND OF THE INVENTION

This invention relates to a fixing device for electrophotography, and more particularly to a contact-heating type fixing device employing a heated roll.

In a contact-heating type fixing device, it has been heretofore required to form a thin film of an offset phenomenon preventive liquid such as a silicone oil on a heated roll for the purpose of preventing deposition of a viscous material such as a toner on the surface of the heated roll (the deposition will be hereinafter referred to as "offset"). In order to supply the offset preventive liquid, it is the general practice to supply the offset preventive liquid continuously to a cleaning member of heat resistant felt or the like with use of a feed roller. The role of the cleaning member of the heat resistant felt material is twofold, one being to clean off a toner which is offset onto a heated roll and the other is to supply the offset preventive liquid uniformly to the heated roll. However, known offset preventive liquid supplying means have various defects, that is to say; they allow deposition of offset toner on the cleaning member during use over a long period of time until it becomes utterly impossible to supply the offset preventive liquid; they are incapable of supplying the offset preventive liquid uniformly over a long time period, forming stains on duplicated sheets due to an excessive feed or failing to give satisfactory offset preventive effects due to an insufficient supply, and they require provision of a container or the like for holding the offset preventive liquid.

BRIEF SUMMARY OF THE INVENTION

The present invention has as its object the elimination of the above-mentioned defects and is characterized by the provision of a cleaning member which is impregnated with an offset phenomenon preventive liquid and a means for supplying continuously said cleaning member in a state compressedly contacted against a heater body by means of a predetermined compressive force.

An embodiment of the invention will now be described with reference to the accompanying drawings.

DETAILED DESCRIPTION OF THE DRAWINGS

FIG. 2 is an elevational schematic representation of a fuser roll pair and release agent applicator; and FIG. 3 is a modified form of the embodiment illustrated in FIG. 2.

DETAILED DESCRIPTION OF THE PREFERRED EMBODIMENT

Figure 1:
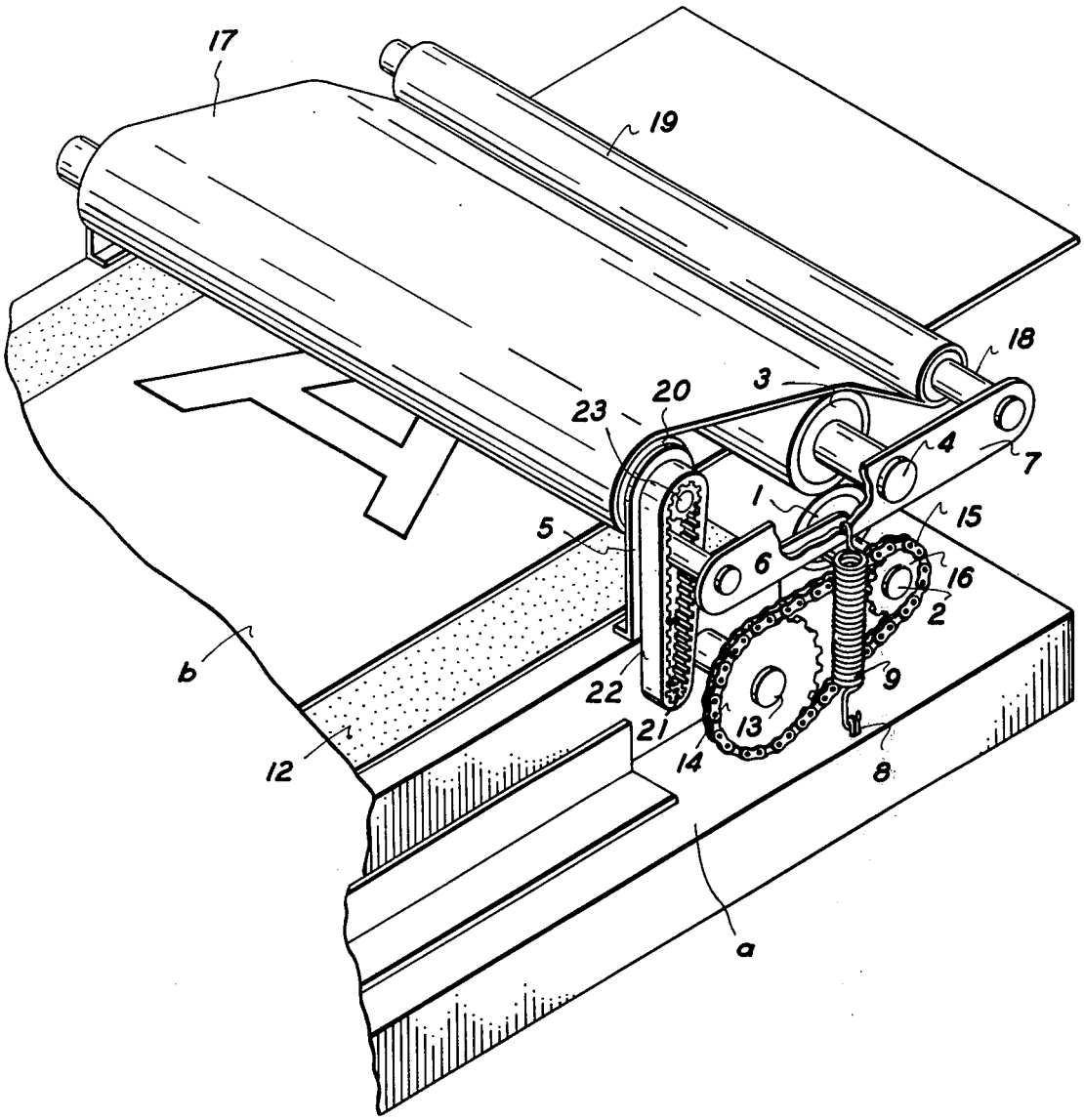
FIG. 1 is a diagrammatic perspective view of a fuser apparatus representing the invention.

FIG. 1 is a diagrammatic perspective view showing the embodiment of the instant invention, wherein there is indicated at 1 compression roll which has shaft 2 pivotally supported on a chassis *a*. Designated at 3 is a heated roll which is held in contact with the compression roll 1 and which is supported on a shaft 4. The shaft 4 is supported on a middle portion of an elongated support member 7 which has one end loosely fitted over a shaft 6 which is in turn supported on a bracket projectingly mounted on the chassis *a*. A spring 9 is interposed between the support member 7 and a stopper 8 which is mounted on the chassis *a* so that the heat roll 3 is pressed against the compression roll 2 by means of a predetermined pressure load. The surfaces of the compression roll 1 and the heat roll 3 are provided with a heat resistant and non-viscous coating of silicone rubber. The heat roll 3 is centrally mounted with a tubular infrared bulb 11 for heating the heat roll 3.

The pressure roll 1 is rotatingly driven from a shaft 13 which is connected to a sheet transfer mechanism (not shown) which serves to move a belt 12 for transferring a support means *b* such as a paper sheet, by way of a chain 15 and a gear 16 on the shaft 2. The heated roll 3 is rotated by friction with the pressure roll 1.

For the prevention of offset on the heated roll 3, a cleaning web 17 which is impregnated beforehand with silicone oil is applied over the entire longitudinal surface area of the heated roll 3. More particularly, as shown in FIGS. 1 and 2, the cleaning web 17 is fed from a feeding core 19 which is journalled on the fore end of the support member 7, toward a take-up core 20 which is journalled on the aforementioned bracket 5, the cleaning web 17 on its way being contacted with the heated roll 3 under a predetermined level of pressure. The feeding roll 19 and the heat roll 3 are mounted on the support member 7 which is adapted to rock about the shaft 6, so that the cleaning web 17 is constantly pressed against the heat roll 3 by a predetermined level of pressure. The aforementioned take-up core 20 is driven from a shaft 21 which is connected to a sheet transfer mechanism (not shown), by way of a belt 22 and shaft 23 of the take-up core 20.

The embodiment shown in FIG. 3 is the same as the aforementioned embodiment only except that the cleaning web 17 is provided in an endless form and therefore detailed description is not given herein for the simplicity of explanation.

In the embodiments of the invention with the construction as described hereinbefore, a toner image *c* is converted into a fixed image *c* while a support *b* of a paper sheet or the like which carries the toner image *c* is passed between the pressure roll 1 and the heated roll 3. It will be appreciated that the surface temperature of the heated roll 3 can be controlled, in a well known manner, for example, as disclosed in U.S. Pat. No. 3,291,466, in order to render the toner particles tacky. In other words the toner should be rendered tacky but not fluid.

In the foregoing embodiments, the heated roll 3 and the pressure roll 1 are formed from aluminum and have a diameter of 60 mm, and the support *b* of paper or the like is transferred at a speed of 150 mm/sec. The cleaning web 17 is formed from 2 mm thick felt and impregnated with silicone oil. If the web is fed at a speed of 1 cm per 1000 copies, the consumption per copy of the silicone oil is 0.003 cc. If the conventional heat roll fixing device is used under the same conditions, the consumption per copy of the silicone oil becomes 0.01 cc and the cleaning felt can serve only for 25,000 copies. In contrast, with the embodiment of the invention as described hereinbefore, the cleaning web can serve for 50,000 copies if it has a length of 50 cm. Furthermore, the conventional heat roll fixing device becomes incapable of smooth oil feeding after duplication of about 15,000 copies. However, the aforementioned embodiment of the invention can effect uniform oil supply until the last copy.

The foregoing embodiments have been described as a so-called contact-heating pressed fixing device using a compression roll, however, it will be understood that the present invention is not limited to this type of fixing device but may be applied to a so-called back heat roll fixing device where a single heat roll is alone brought into contact with a back surface of a support such as paper sheet or to a contact-heating fixing device employing a heater in the form of a belt instead of a heated roll. Furthermore, the coating of the compression roll and the heated roll is not limited to the particular example shown hereinbefore. Therefore, it will be appreciated that the present invention includes all possible changes and modifications except as depart from the spirit and technical scope of the present invention.

Since many changes could be made in the above-construction without departing from the scope of the invention, it is intended that all matter contained in the above-description or shown in the accompanying drawings shall be interpreted as illustrative and not in a limiting sense.

What is claimed is:

1. Fuser apparatus for fixing toner images to support members, said apparatus comprising:

a pair of nip forming members between which said support members move with said toner images contacting a heated one of said nip forming members;

means for elevating the surface temperature of said heated member to thereby render said toner images tacky;

an elongated cleaning member impregnated with offset preventing material, said elongated cleaning member comprising an endless member;

means for stationarily supporting a portion of said elongated member in intimate contact with the surface of said heated one of said members whereby said surface is simultaneously cleaned and said offset preventing material is applied to said surface; and means for effecting movement of said elongated member whereby different portions thereof are brought into intimate contact with said surface at periodic intervals.

2. Fuser apparatus for fixing toner images to support members, said apparatus comprising:

a pair of nip forming members between which said support members move with said toner images contacting a heated one of said nip forming members;

means for elevating the surface temperature of said heated member to thereby render said toner images tacky;

an elongated cleaning member impregnated with offset preventing material, such elongated cleaning member comprising a web adapted to be transported between supply and take-up cores;

means for stationarily supporting a portion of said elongated members in intimate contact with the surface of said heated one of said members whereby said surface is simultaneously cleaned and said offset preventing material is applied to said surface; and means for effecting movement of said elongated member whereby different portions thereof are brought into intimate contact with said surface at periodic intervals.

3. Apparatus according to claim 1, wherein said cleaning member is impregnated with silicone oil.

4. Apparatus according to claim 3, wherein said cleaning member is fabricated from felt material.

5. Apparatus according to claim 4, wherein said nip forming members comprise roll members.

6. Apparatus according to claim 5, wherein the surface of said heated roll comprises a coating of silicone rubber.

7. Apparatus according to claim 2, wherein said cleaning member is impregnated with silicone oil.

8. Apparatus according to claim 7, wherein said cleaning member is fabricated from felt material.

9. Apparatus according to claim 8, wherein said nip forming members comprise roll members.

10. Apparatus according to claim 9, wherein the surface of said heated roll comprises a coating of silicone rubber.

* * * * *